US007882857B1

(12) United States Patent
Ueda

(10) Patent No.: US 7,882,857 B1
(45) Date of Patent: Feb. 8, 2011

(54) INDUSTRIAL TWO-LAYER FABRIC

(75) Inventor: Ikuo Ueda, Shizuoka (JP)

(73) Assignee: Nippon Filcon Co., Ltd.

( * ) Notice: Subject to any disclaimer, the term of this patent is extended or adjusted under 35 U.S.C. 154(b) by 0 days.

(21) Appl. No.: 12/591,705

(22) Filed: Nov. 30, 2009

(30) Foreign Application Priority Data

Nov. 28, 2008 (JP) ..... 2008-303882

(51) Int. Cl.
*D21F 7/08* (2006.01)
*D03D 3/04* (2006.01)
*D21F 1/10* (2006.01)

(52) U.S. Cl. ..... 139/383 A; 139/383 R; 162/358.2

(58) Field of Classification Search ..... 139/383 R, 139/383 A, 383 AA, 408, 411, 412, 413, 139/414; 162/348, 358.1, 358.2, 900, 902, 162/903, 904
See application file for complete search history.

(56) References Cited

U.S. PATENT DOCUMENTS 5,379,808 A 1/1995 Chiu
6,827,821 B2 * 12/2004 Brewster et al. ..... 162/358.2
7,059,359 B2 * 6/2006 Quigley et al. ..... 139/383 A
7,357,156 B2 * 4/2008 Ueda et al. ..... 139/383 A
7,357,157 B2 * 4/2008 Ueda ..... 139/383 A
7,426,943 B2 * 9/2008 Ueda et al. ..... 139/383 A
2006/0102244 A1 * 5/2006 Ueda et al. ..... 139/383 A
2006/0278297 A1 * 12/2006 Ueda ..... 139/383 A

FOREIGN PATENT DOCUMENTS

JP 2004-068168 A 3/2004

* cited by examiner

*Primary Examiner*—Bobby H Muromoto, Jr.
(74) *Attorney, Agent, or Firm*—Rader, Fishman & Grauer PLLC

(57) ABSTRACT

The industrial two-layer fabric has at least warp binding yarn pairs having an upper side warp and a warp binding yarn arranged vertically. On the upper side, between knuckles that two adjacent upper side warps have formed by passing over one or two upper side wefts, a warp binding yarn passes over one upper side weft to form a knuckle, whereby knuckles of the upper side warp, the warp binding yarn, and the upper side warp are formed in the mention of order over the one upper side weft. In the industrial two-layer fabric thus formed, the knuckle of the warp binding yarn does not protrude further than the knuckle of the upper side warps.

5 Claims, 5 Drawing Sheets

INDUSTRIAL TWO-LAYER FABRIC

CROSS-REFERENCES TO RELATED APPLICATION

This application claims priority from Japanese Patent Application Serial No. 2008-303882 filed Nov. 28, 2008, the contents of which are incorporated herein by reference in its entirety.

BACKGROUND OF THE INVENTION

1. Field of the Invention

The present invention relates to an industrial two-layer fabric having uniform dehydration characteristics throughout the fabric without causing closing of the mesh openings thereof which will otherwise occur at weaving portions of binding yarns.

2. Description of the Related Art

Fabrics made by weaving warps and wefts have heretofore been used widely as industrial fabrics and they are, for example, papermaking fabrics, conveying belts, and filter cloths. They are required to have fabric properties suited for using purposes or using environments. Requirements for papermaking fabrics to be used in a papermaking step for removing water from raw materials by utilizing meshes of the fabrics are especially strict.

For example, there is a demand for fabrics that have excellent surface smoothness and therefore do not easily transfer a wire mark of the fabrics to paper, fabrics having a sufficient dehydration property to completely and uniformly remove excess water contained in the raw materials and having sufficient rigidity and wear resistance for suitable use of them even under severe environments, and fabrics capable of maintaining conditions necessary for making paper of a good quality for a long period of time.

There is also a demand for fabrics having a fiber supporting property, capable of improving a papermaking yield, having size stability, and having running stability, and the like.

The demand for papermaking fabrics has become severe with a recent increase in the speed of a papermaking machine.

Among industrial fabrics, papermaking fabrics must satisfy the most severe requirements so that a description on them will promote understanding of the requirements for most of the industrial fabrics and solutions of them. Therefore, they will hereinafter be described using papermaking fabrics as one example.

With a recent increase in the speed of a papermaking machine, papermaking fabrics are required to have a particularly excellent dehydration property and surface smoothness. Although dehydration characteristics differ with the type of a machine employed or the type of a product to be manufactured, a uniform dehydration property is one of essential conditions for any product.

Further, it becomes more difficult to satisfy the demand for papermaking fabrics because an increase in a mixing rate of minute fibers in raw materials as a result of recent increased use of waste paper causes insufficient dehydration so that sufficient and uniform dehydration has gained in importance.

When water to be dehydrated is retained in the fabric upon papermaking, it swashes on the wet paper and becomes a defect. A method of decreasing a mesh thickness is employed with a view to reducing water retention. An example of a flat yarn is shown in U.S. Pat. No. 5,379,808.

FIGS. 2, 5, and 8 of U.S. Pat. No. 5,379,808 are plan views illustrating three examples. They are examples of a two-layer fabric having a binding yarn for weaving an upper side weft and a lower side weft. The warp binding yarn is woven with a lower side weft in the lower layer and with an upper side weft in the upper layer. It forms a weaving portion in parallel with a knuckle of an upper side warp.

The fabric has no lower side warps. It can suppress occurrence of a defect on paper during papermaking by using flat yarns or laying two small-diameter warp binding yarns in parallel to decrease a mesh thickness and thereby decreasing a water retention amount of the mesh. Since the weaving portions of warp binding yarns on the upper side are parallel with the knuckles of upper side warps so that the mesh openings are narrowed with the binding yarns only at these portions. Such a change in water drainage property sometimes results in production of paper having an uneven thickness.

Japanese Patent Laid-Open No. 2004-68168 shows a two-layer fabric having pairs of an upper side warp and a warp binding yarn with a view to achieving a uniform dehydration property. This fabric has a uniform design on the surface thereof by using an upper side knuckle of warp binding yarns for weaving upper and lower layers and an upper-side warp design in combination. Although the fabric can keep its design because the two warps cooperatively form, on the surface thereof, a design corresponding to one warp, they form intersections and at the same time, the knuckles of warp binding yarns do not completely move on the line of upper side warps but are present in parallel therewith. Mesh openings are therefore clogged at portions where knuckles of warp binding yarns exist, which may cause a partial change in the dehydration property and inevitably provide paper with a watermark.

SUMMARY OF THE INVENTION

An object of the invention is to provide an industrial two-layer fabric having a uniform dehydration property throughout the fabric without causing a conventional problem, that is, closing of mesh openings with binding yarns and excellent in surface smoothness.

One of the main characteristics of the industrial multilayer fabric according to the invention is that it employs a design constitution preventing mesh openings from being clogged with upper side knuckles of warp binding yarns.

The present inventors have adopted the following constitutions with a view to overcoming the above problem.

(1) In the invention, there is provided an industrial two-layer fabric having upper side warps to be woven with upper side wefts and warp binding yarns to be woven with both upper side wefts and lower side wefts. The upper side warp and the warp binding yarn forms a pair and are arranged vertically. On the upper side, two adjacent upper side warps form knuckles by passing over one or two upper side wefts. Between these knuckles, a warp binding yarn passes over one upper side weft to form another knuckle, whereby knuckles are formed with the upper side warp, the warp binding yarn and the other upper side warp in this order over an upper side weft. The knuckle of the binding yarn is formed so as not to protrude further than the adjacent knuckles of the upper side warps.

(2) There is also provided the industrial two-layer fabric as described above in (1), the fabric may have, in addition to the pair of a warp binding yarn and an upper side warp, a pair of an upper side and lower side warps. In this case, the upper side warp is woven with an upper side weft and the lower side warp is woven with a lower side weft.

(3) There is also provided the industrial two-layer fabric as described above in (1) or (2), wherein the fabric has, on the upper side, an interweaving design in which an upper side warp passes over and under one upper side weft and an interweaving design in which an upper side warp passes over and under two upper side wefts; and these two warp designs are arranged alternately.

The industrial two-layer fabric of this invention has, as constituent yarns, upper side warps to be woven with upper side wefts and warp binding yarns for weaving both the upper side wefts and lower side wefts. The upper side warps and the warp binding yarns are arranged vertically to constitute warp binding yarn pairs.

Although the upper side warps and the warp binding yarns are arranged vertically, the upper side warps are woven with only the upper side wefts and the warp binding yarns are woven with both the upper side wefts and the lower side wefts. This means that the upper side warps and the warp binding yarns are not completely overlapped with each other and actually they are misaligned.

The industrial two-layer fabric may have, in addition to the warp binding yarn pairs, upper/lower warp pairs composed of upper side warps to be woven with upper side wefts and lower side warps to be woven with lower side wefts.

Upper side warps each has a design in which it passes over one or two upper side wefts and then passes under one or more upper side wefts, while warp binding yarns each has a design in which it passes over one upper side weft and then passes under at least one lower side weft, thus weaving these wefts together. A knuckle formed by a warp binding yarn on the upper side is arranged between knuckles formed by two adjacent upper side warps.

The industrial two-layer fabric according to the invention will hereinafter be described by comparing it with that of the related art. FIG. 7 is a photograph showing the upper side of the fabric of the invention and FIG. 8 is a photograph showing the cross-section taken along the warp of the fabric of FIG. 7. FIG. 9 is a photograph showing the upper side of the fabric of the related art and FIG. 10 is a photograph showing the cross-section taken along the warp of the fabric.

In the fabric of FIG. 9, upper and lower fabric layers are woven without a collapse in the design by supplementing a portion of the upper side warp, which lacks a knuckle in successive weaving positions, with a knuckle formed by a warp binding yarn (in the circle illustrated in FIG. 9).

In fact, at a portion where a warp binding yarn forms a knuckle on the upper side, the upper side warp forms an intersection so that they are arranged laterally and therefore cannot completely exist on the side of the upper side warp. This means that the mesh opening is clogged compared with that of the other part. The knuckles supplemented by the warp binding yarn align obliquely and continuously so that there appears a clear boundary between lines y-y and z-z of FIG. 9 where mesh openings are wide, and between lines x-x and y-y of FIG. 9 where mesh openings are tight and an oblique streak can be observed. They may inevitably give oblique marks to paper upon dehydration.

In the related art, at a portion where the knuckle of a warp binding yarn appears from the surface, the size of the mesh opening becomes different from that of the other mesh opening, whereby streaks inevitably appear. On the other hand, a knuckle of a warp binding yarn B in the present embodiment illustrated in FIG. 8 does not protrude further from the surface side than the upper side warps, though they are similar two-layer fabrics using warp binding yarns. As a result, there are substantially no mesh openings partially clogged with the knuckle. This means that at a site where two continuous upper side warps pass over one upper side weft, while lying side by side, the upper side weft is drawn towards the lower side. A warp binding yarn is caught at the center of the thus drawn portion and forms a knuckle so that the warp binding yarn does not protrude to the surface side than the upper side warp and does not appear at a position to fill the mesh opening therewith. When the binding yarn is present at this position, a dehydration route in the oblique direction can be ensured so that no partial closing of the mesh opening as observed in the related art occurs and marked effects such as uniform dehydration property and excellent surface smoothness can be produced. Such a structure and function can be understood from the comparison between FIGS. 7 and 8 and FIGS. 9 and 10.

Further, comparison between FIG. 8 and FIG. 10 has revealed that the warp binding yarn B of the invention illustrated in FIG. 8 does not form an intersection with an upper side warp and at the same time it does not protrude from the surface. On the other hand, the warp binding yarn b of the related art illustrated in FIG. 10 appears and protrudes from the surface of the fabric at a portion where it passes over an upper side weft. This protrusion adversely affects the surface smoothness.

With regard to this withdrawal, correction can be made to some extent by changing weaving conditions such as weaving tension or changing the kind of a wire material, but intersection with an upper side warp cannot be avoided. In the fabric of the related art, an upper side knuckle of a warp binding yarn sometimes withdraws and sometimes protrudes, which adversely affects the surface smoothness.

In the upper side design, an upper side warp has a design in which it passes over one or two upper side wefts and a knuckle formed by a warp binding yarn on the upper side is sandwiched between knuckles formed by two upper side warps adjacent to each other.

As a warp design, a 2/2 design in which a warp passes over and under two upper side wefts may be arranged successively or a 2/2 design in which a warp passes over and under two upper side wefts and a 1/1 design in which a warp passes over and under one upper side weft may be arranged alternately. Alternate arrangement of two warp designs in such a manner is preferred because it can bring out the advantages of respective designs while negating the disadvantages thereof. For example, the 1/1 design is excellent in rigidity and stability because of many weaving times, but the limit shooting count of wefts is small because of frequent weaving times. Use of a small number of wefts may lead to deterioration of fiber supporting property and reduction in yield. On the other hand, the number of weaving times is smaller in the 2/2 design than in the 1/1 design so that the shooting count of wefts can be increased, which however leads to a problem in rigidity.

It is possible to increase the shooting count and improve the rigidity by arranging these designs alternately.

Examples of other usable designs include successive arrangement of a 1/4-1/2 design in which a warp passes over one upper side weft, under four upper side wefts, over one upper side weft, and under two upper side wefts; and successive arrangement of a design in which a warp passes over one upper side weft, under three upper side wefts, over two upper side wefts, and under two upper side wefts. In any of them, a design in which an upper side knuckle formed by a warp binding yarn passing over an upper side weft is sandwiched between knuckles formed by two upper side warps adjacent to each other.

Warp binding yarns each has a design having two portions, one portion passing over one upper side weft and the other portion passing under at least one lower side weft. The position of a knuckle formed by a warp binding yarn passing over an upper side weft should be examined. The closing of mesh openings cannot be prevented and the characteristic of the invention cannot be exhibited unless an upper side knuckle of a warp binding yarn is located at a proper position. Employment of a design in which a warp binding yarn passes over two or more upper side wefts may make the distance of wefts uneven and a uniform dehydration property cannot be attained because the wefts approach to each other, though it depends on the design of an upper side warp.

With regard to the lower side design, a warp binding yarn is woven with a lower side weft to form at least a part of the lower side design. When the fabric has a lower side warp, the warp binding yarn and the lower side warp are preferably woven with the lower side weft to form a regular lower side design. Alternatively, the warp binding yarn may be used not for the formation of the lower side design but as a simple binding yarn. A lower side weft having a long crimp structure is preferred, depending on the intended use of the resulting fabric. A lower side weft may have a design in which it passes over two warps and passes under six warps to form a long crimp structure or a ribbed weave design in which two warps form a plain weave, while being laid in parallel.

Yarns to be used for the industrial two-layer fabric of the invention may be selected depending on the using purpose. Examples of them include, in addition to monofilaments, multifilaments, spun yarns, finished yarns subjected to crimping or bulking such as so-called textured yarn, bulky yarn and stretch yarn, and yarns obtained by intertwining them. As the cross-section of the yarn, not only circular form but also square or short form such as stellar form, or elliptical or hollow form can be used. The material of the yarn can be selected freely and usable examples of it include polyester, polyamide, polyphenylene sulfide, polyvinylidene fluoride, polypropylene, aramid, polyether ether ketone, polyethylene naphthalate, polytetrafluoroethylene, cotton, wool and metal. Of course, yarns obtained using copolymers or incorporating or mixing the above-described material with a substance selected depending on the intended purpose may be used.

Various materials can be used for a papermaking wire. As upper side warps, lower side warps, warp binding yarns, and upper side wefts, it is usually preferred to use polyester monofilaments having rigidity and excellent size stability. As lower side wefts required to have wear resistance, those obtained by alternately arranging polyester monofilaments and polyamide filaments are preferred, because interweaving them is effective for improving wear resistance while maintaining rigidity.

With regard to the diameter of constituent yarns, upper side wefts have preferably a smaller diameter than lower side wefts from the standpoint of surface smoothness and fiber supporting property. The diameter of warps can be selected as needed. All the warps may have an equal diameter or the diameter of lower side warps may be made greater than that of other warps. The diameter may be selected as needed.

The industrial two-layer fabric according to the invention can keep a uniform dehydration property throughout the fabric without closing the mesh openings with a binding yarn and at the same time, can have excellent surface smoothness.

DESCRIPTION OF REFERENCE NUMERALS AND SIGNS

1*u*, 2*u* . . . upper side warp
2*d*, 4*d* . . . lower side warp
B, b, 1B, 3B . . . warp binding yarn
1'*u*, 2'*u* . . . upper side weft
1'*d*, 3'*d* . . . lower side weft

DESCRIPTION OF THE PREFERRED EMBODIMENT

The embodiments of the invention will hereinafter be described referring to accompanying drawings.

FIGS. 1 to 6 are design diagrams illustrating examples of the present invention.

The term "design diagram" as used herein means a minimum repeating unit of a weave pattern (which may also be called "complete design"). The whole weave pattern is formed by connecting this complete design longitudinally and latitudinally. In the design diagram, warps are indicated by Arabic numerals, for example 1, 2 and 3. Warp binding yarns for weaving upper and lower wefts are indicated by Arabic numerals with "B", upper side warps are indicated by Arabic numerals with "u", and lower side warps are indicated by Arabic numerals with "d". In the design diagram, warps with the same number form a pair. An upper side warp "u" and a warp binding yarn "B" constitutes a warp binding yarn pair and an upper side warp "u" and a lower side warp "d" constitute an upper/lower warp pair.

Figure 10:
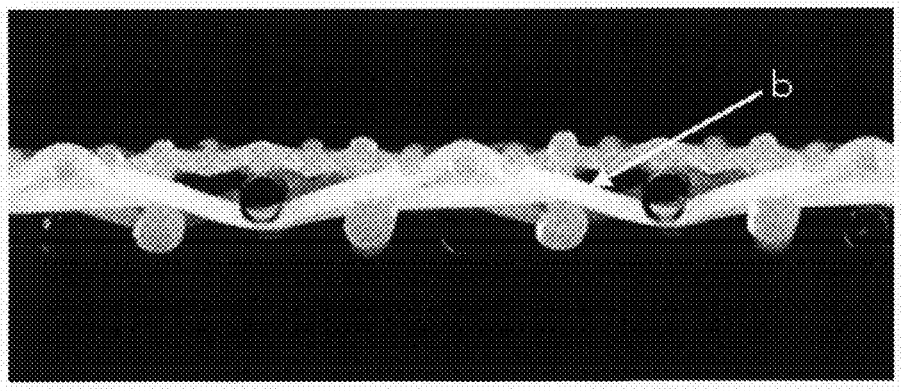
FIG. 10 is a photograph showing the cross-section taken along a warp of the fabric according to the related art of FIG. 9.

Wefts are indicated by Arabic numerals with a prime, for example, 1', 2' and 3'. Upper side wefts and lower side wefts are arranged vertically but upper side wefts sometimes do not have lower side wefts thereunder, which depends on an arrangement ratio. Upper side wefts are indicated by Arabic numerals with "u" and lower side wefts are indicated by Arabic numerals with "d", for example 1'*u*, 2'*d*. In the fabric of the related art illustrated in FIG. 10, warp binding yarns are indicated by "b".

In these design diagrams, a mark "x" indicates that an upper side warp (u) lies over an upper side weft to form a knuckle; a mark "□" indicates that a lower side warp (d) lies under a lower side weft to form a knuckle. A mark "♦" indicates that a warp binding yarn (B) lies over an upper side weft to form a knuckle; and a mark "◇" indicates that the warp binding yarn (B) lies under a lower side weft to form a knuckle.

In the design diagrams, yarns are vertically overlapped precisely. They are however illustrated as such for convenience of drawing and misalignment sometimes occurs in the actual fabric.

Embodiment 1

Figure 1:
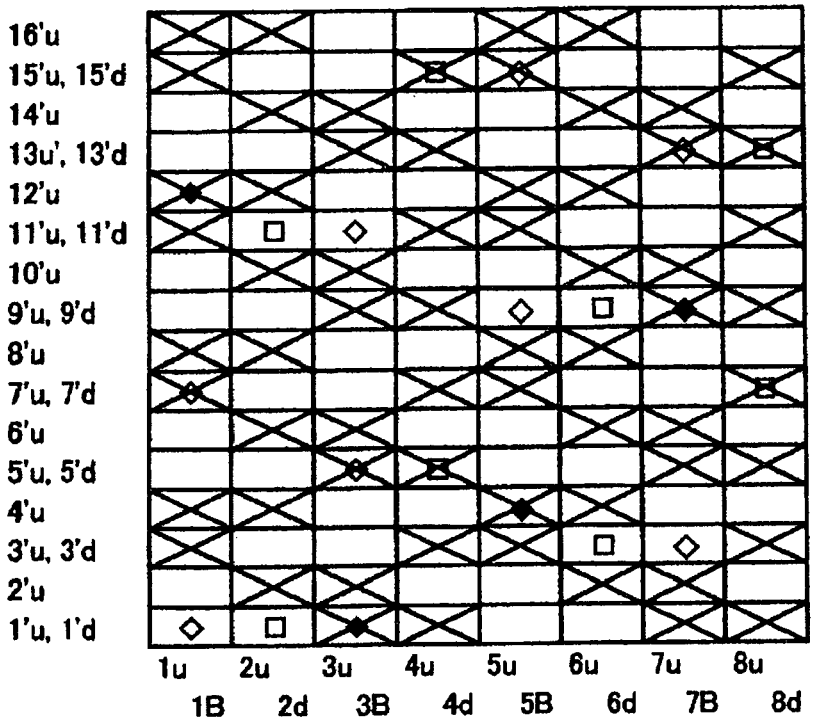
FIG. 1 is a design diagram illustrating the complete design of Embodiment 1 according to the invention.

FIG. 1 is a design diagram of a fabric of Embodiment 1 according to the invention. The fabric is a 16-shaft one in which warp binding yarn pairs (1, 3, 5, and 7) composed of an upper side warp (u) and a warp binding yarn (B) and upper/lower warp pairs (2, 4, 6, and 8) composed of an upper side warps (u) and a lower side warps (d) have been arranged alternately. Upper side wefts and lower side wefts are arranged at a 2:1 ratio.

Upper side warps each has a 2/2 design and a 1/1 design alternately. In the former one, upper side warps 1*u*, 3*u*, 5*u* and 7*u* pass over and under two upper side wefts, while upper side warps 2*u*, 4*u*, 6*u* and 8*u* pass over and under one upper side weft. Between two knuckles formed by two adjacent upper side warps passing over one or two upper side wefts, a warp binding yarn forms a knuckle passing over one upper side weft at the position shown with a mark "◆." In the present embodiment, a warp binding yarn forms a weaving portion between one of the knuckles of the upper side warps 1*u*, 3*u*, 5*u*, and 7*u* each having a 2/2 design and one of the knuckles of the upper side warps 2*u*, 4*u*, 6*u*, and 8*u* each having a 1/1 design.

Figure 8:
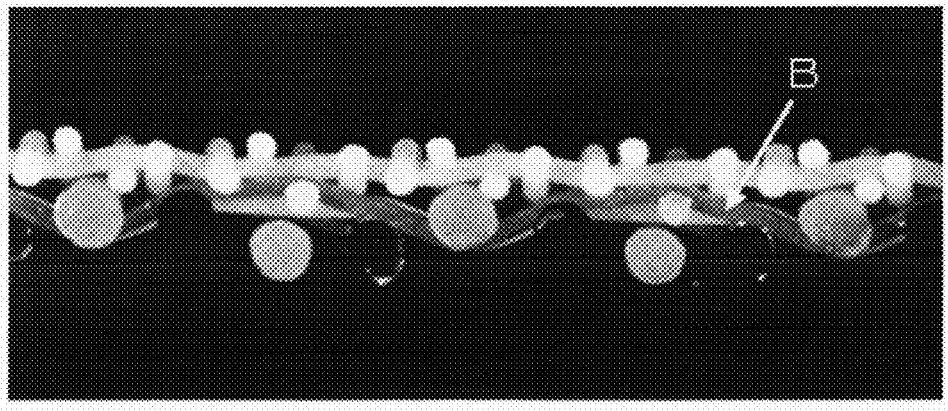
FIG. 8 is a photograph showing the cross-section taken along a warp of the fabric according to the invention.
Figure 9:
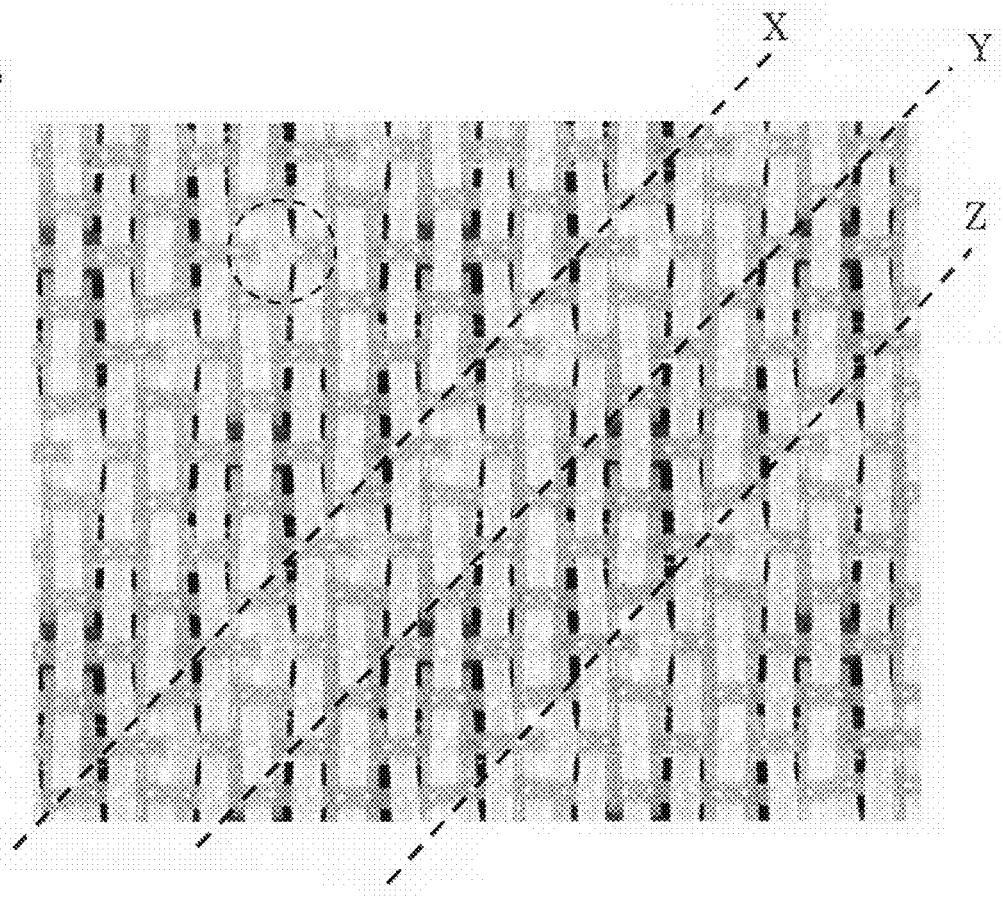
FIG. 9 is a photograph showing the upper side surface of a fabric according to the related art.

Described specifically, the fabric of this embodiment has a design in which between a knuckle that the upper side warp 1*u* has formed by passing over two upper side wefts 11'*u* and 12'*u* and a knuckle that the upper side warp 2*u* adjacent to the warp 1*u* has formed by passing over the upper side weft 12'*u*, a warp binding yarn 1B forms a knuckle over the upper side weft 12'*u*. From the standpoint of its design, the knuckles of the upper side warp 1*u*, the warp binding yarn 1B, and the upper side warp 2*u* are formed in the order of mention on the upper side weft 12'*u*. It is however to be noted that due to the design in which the two adjacent upper side warps 1*u* and 2*u* pass over the upper side weft 12'*u*, the upper side weft 12'*u* lies therebelow between the knuckles and the warp binding yarn 1B forms a weaving portion at the center between the knuckles so that the knuckle of the warp binding yarn does not protrude or project to a position equal in height to the upper side warps 1*u* and 2*u* and the knuckle exists below the upper side warps 1*u* and 2*u* (refer to FIG. 8). In other words, the degree of projections of the knuckles formed by the warp binding yarns on the upper surface of the fabric is lower than that of the knuckles formed by the upper side warps on the upper surface of the fabric.

After the warp binding yarn is woven with the upper side weft, it goes to the lower layer and is woven with two separate lower side wefts, whereby the upper layer fabric and the lower layer fabric are connected to each other.

In the lower layer, a lower side warp and a warp binding yarn are woven with a lower side weft to form a lower layer design. On the lower side, the warp binding yarn functions as a lower side warp and forms its design.

Warps on the lower side each has a 1/4-1/2 design. It passes, together with right and left warps adjacent thereto, under the same lower side weft and therefore forms a zigzag design in which the warp snakes from side to side to form a weaving portion. This design improves rigidity in the oblique direction. Lower side wefts each has a design in which it passes over two warps and then passes under six warps to form a long crimp. The lower side wefts each has a design having excellent wear resistance in which it passes over two warps and then forms a long crimp corresponding to six warps.

The fabric of Embodiment 1 has, on the upper side, a structure in which an upper side warp (such as 1*u* or 3*u*) having an interweaving design in which it passes over and under two upper side wefts and an upper side warp (such as 2*u* or 4*u*) having an interweaving design in which it passes over and under one upper side weft are arranged alternately.

Embodiment 2

Figure 2:
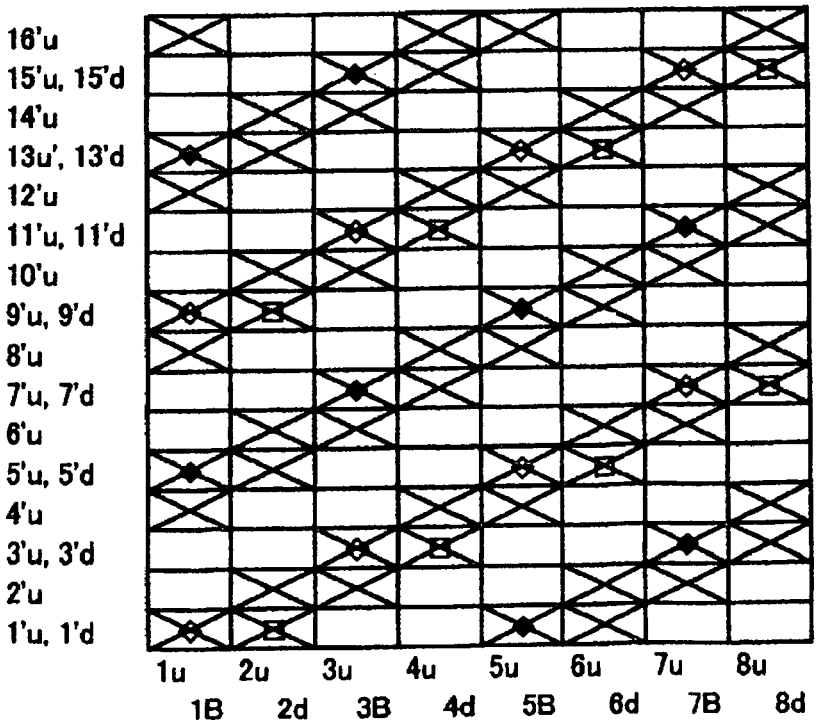
FIG. 2 is a design diagram illustrating the complete design of Embodiment 2 according to the invention.

FIG. 2 is a design diagram of a fabric according to Embodiment 2 of the invention. Similar to Embodiment 1, warp binding yarn pairs and upper/lower warp pairs are arranged alternately. Upper side warps each has a 2/2 design and a warp binding yarn forms a weaving portion (◆) between knuckles of two upper side warps adjacent to each other.

Embodiment 3

Figure 3:
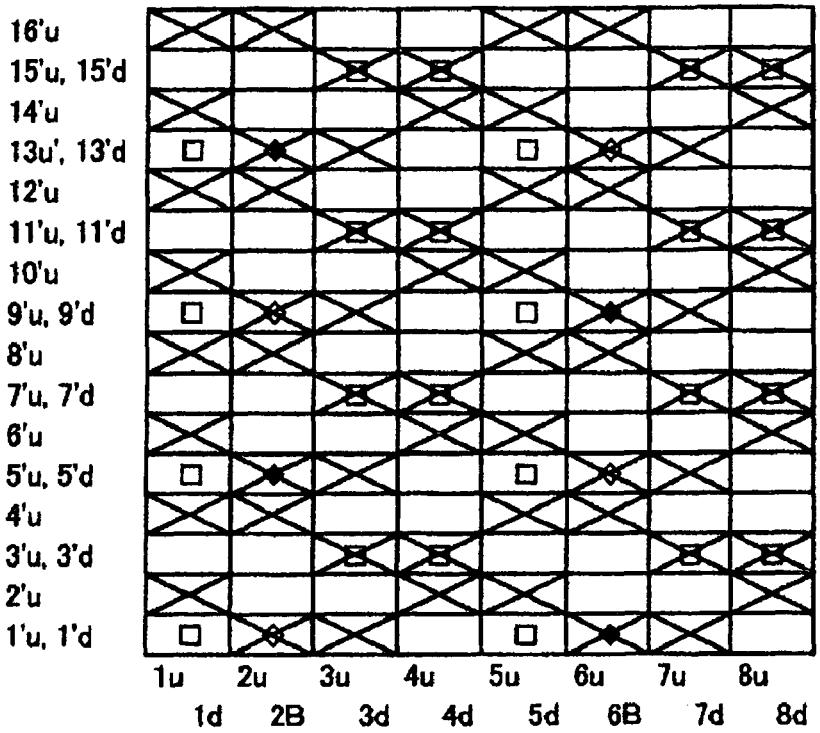
FIG. 3 is a design diagram illustrating the complete design of Embodiment 3 according to the invention.

FIG. 3 is a design diagram of a fabric according to Embodiment 3 of the invention. Similar to Embodiment 1, an upper side warp has a 1/1 design and a 2/2 design arranged alternately. An arrangement ratio of warp binding yarns is smaller than that of the above embodiment. Even at such an arrangement ratio, however, due to binding with a machine-direction yarn on which a tension is applied, there is no fear of occurrence of internal wear or peeling which will otherwise occur as a result of loosening of a binding force between upper and lower layers. A lower side weft has two designs arranged alternately, that is, a design in which it passes over two warps, under two warps, over one warp, and under three warps and a design in which it passes over two warps and under two warps.

The fabric according to Embodiment 3 has, on the upper side, a structure in which an upper side warp (such as 2*u* or 4*u*) having an interweaving design in which it passes over and under two upper side wefts and an upper side warp (such as 1*u* or 3*u*) having an interweaving design in which it passes over and under one upper side weft are arranged alternately.

Embodiment 4

Figure 4:
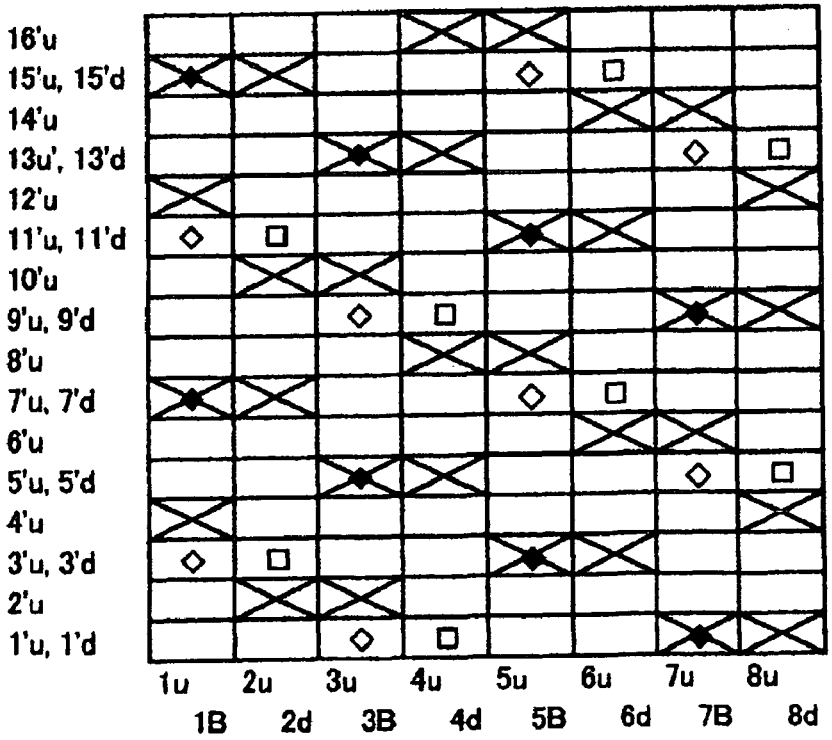
FIG. 4 is a design diagram illustrating the complete design of Embodiment 4 according to the invention.

FIG. 4 is a design diagram of a fabric according to Embodiment 4 of the invention. An upper side warp has a 1/4-1/2 design in which it passes over one upper side weft, under four upper side wefts, over one upper side weft, and under two upper side wefts. On the lower side layer, two adjacent warps, which are laid parallel, pass over and under the same lower side weft. Lower side wefts each has a design in which it passes over two warps and under six warps to form a long crimp.

Embodiment 5

Figure 5:
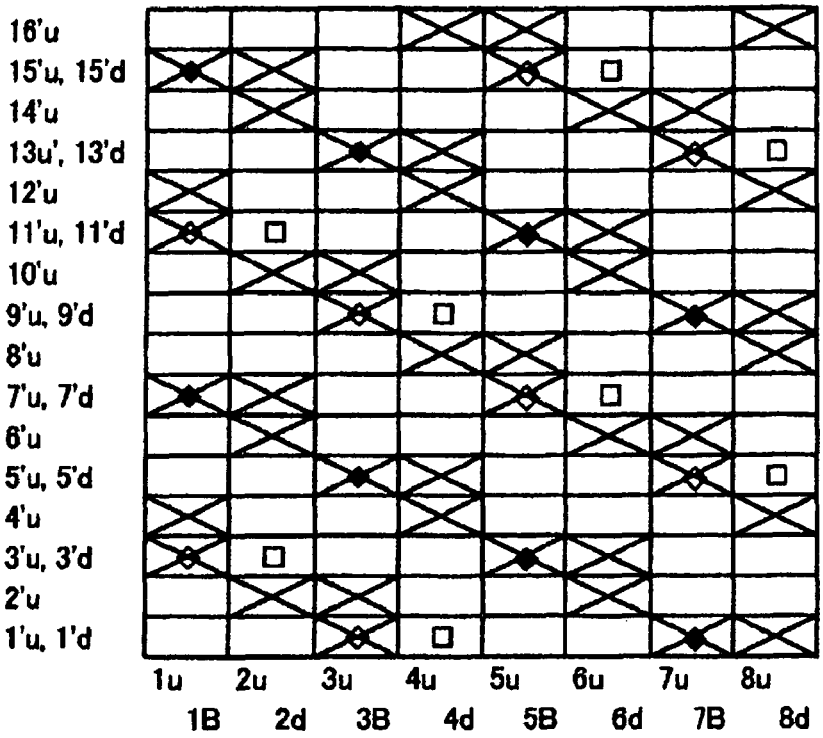
FIG. 5 is a design diagram illustrating the complete design of Embodiment 5 according to the invention.

FIG. 5 is a design diagram of a fabric according to Embodiment 5 of the invention. An upper side warp has a 2/2-1/3 design in which it passes over two upper side wefts, under two upper side wefts, over one upper side weft, and under three upper side wefts. The upper side layer has a design in which two adjacent warps, which are laid parallel, pass over and under the same lower side weft. Lower side wefts each has a design in which it passes over two warps and under six warps to form a long crimp.

Embodiment 6

Figure 6:
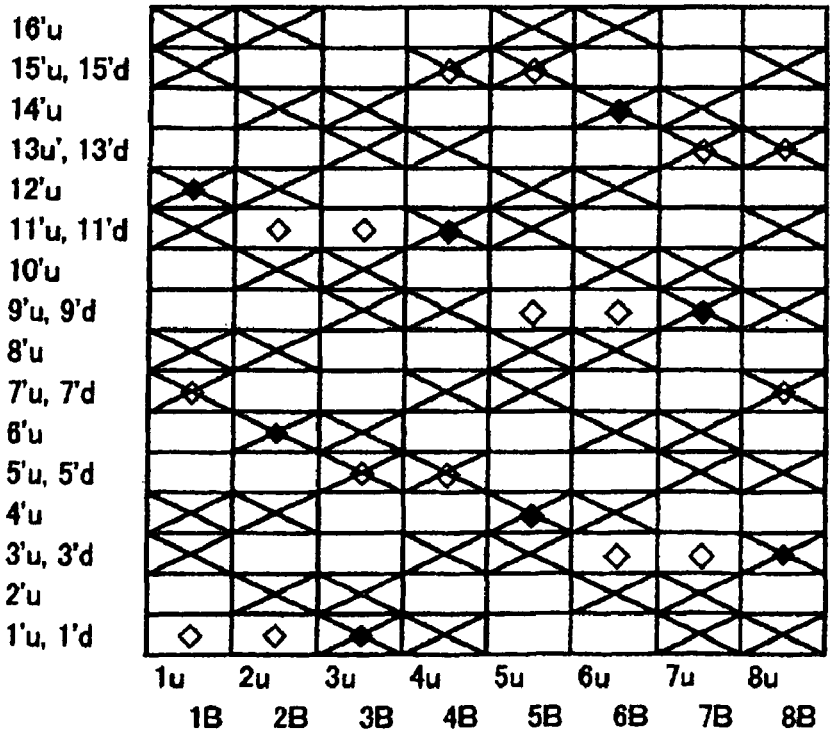
FIG. 6 is a design diagram illustrating the complete design of Embodiment 6 according to the invention.
Figure 7:
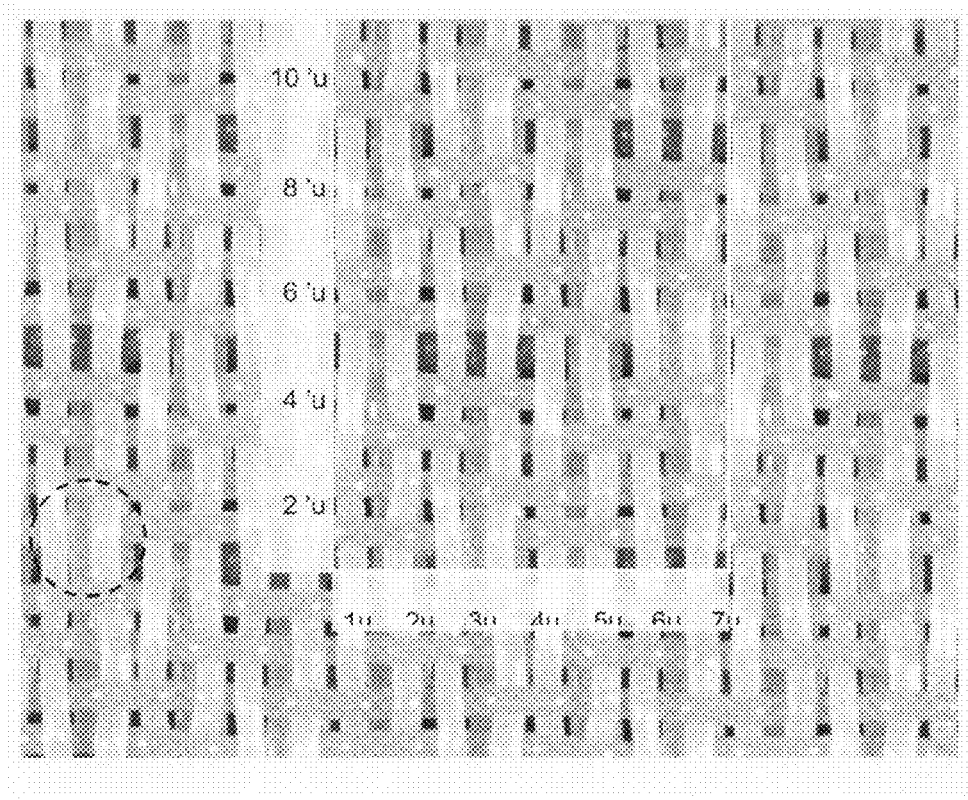
FIG. 7 is a photograph showing the upper side surface of a fabric according to the invention.

FIG. 6 is a design diagram of a fabric according to Embodiment 6 of the invention. Upper side warps are each composed of two designs similar to Embodiment 1. In this embodiment, all the warps constitute warp binding yarn pairs and there exists no lower side warp. Such a structure poses no problem.

Warps on the lower side each has a 1/4-1/2 design and form a zigzag design similar to that of Embodiment 1. Lower side wefts each has a design in which it passes over two warps and passes under six warps to form a long crimp.

The fabric of Embodiment 6 has a structure in which an upper side warp (such as 1*u* or 3*u*) having an interweaving design in which it passes over and under two upper side wefts and an upper side warp (such as 2*u* or 4*u*) having an interweaving design in which it passes over and under one upper side weft are arranged alternately.

What is claimed is:

1. An industrial two-layer fabric having an upper side and a lower side comprising upper side warps woven with upper side wefts and warp binding yarns woven with both upper side wefts and lower side wefts, wherein each of the warp binding yarns forms a pair arranged vertically with the upper side warp, the fabric further comprising in a repeating unit:

a first knuckle on the upper side formed by the warp binding yarn that passes over one of the upper side wefts;

second knuckles on the upper side formed by two adjacent upper side warps that pass over the one of the upper side wefts;

wherein the first knuckle is formed between the two second knuckles whereby the first knuckle protrudes lower than the second knuckles.

2. The industrial two-layer fabric according to claim 1, wherein the first knuckle is formed by the warp binding yarn that passes over the one of the upper side wefts and another upper side weft which is arranged adjacent to the one of the upper side wefts.

3. The industrial two-layer fabric according to claim 1, wherein at least one of the second knuckles is formed by the upper side warp that passes over the one of the upper side wefts and another upper side weft which is arranged adjacent to the one of the upper side wefts.

4. The industrial two-layer fabric according to claim 1, further comprising pairs arranged vertically of upper side warps woven with upper side wefts and lower side warps woven with lower side wefts.

5. The industrial two-layer fabric according to claim 1, wherein the fabric comprises, on the upper side, a first upper side warp that passes over one upper side weft then passes under another upper side weft alternately and a second upper side warp that passes over two upper side wefts then passes under two upper side wefts alternately, wherein the first upper side warp and the second upper side warp are arranged alternately.

* * * * *